US005620052A

United States Patent [19]

Turner

[11] Patent Number: 5,620,052

[45] Date of Patent: Apr. 15, 1997

[54] HANGER SUSPENSION SYSTEM

[76] Inventor: Edwin C. Turner, 7500 Pinemont, #2110, Houston, Tex. 77040-6431

[21] Appl. No.: 473,443

[22] Filed: Jun. 7, 1995

[51] Int. Cl.[6] ..... E21B 43/01

[52] U.S. Cl. ..... 166/348; 166/208

[58] Field of Search ..... 166/348, 382, 166/208, 216, 217

[56] References Cited

U.S. PATENT DOCUMENTS

| | | | |
|---|---|---|---|
| 3,918,747 | 11/1975 | Putch | 285/4 |
| 3,971,576 | 7/1976 | Herd et al. | 285/87 |
| 4,139,059 | 2/1979 | Carmichael | 166/208 |
| 4,295,665 | 10/1981 | Pierce | 285/3 |
| 4,355,825 | 10/1982 | Leicht | 285/3 |
| 4,422,507 | 12/1983 | Reimert | 166/348 |
| 4,468,055 | 8/1984 | Reimert | 285/141 |
| 4,491,346 | 1/1985 | Walker | 285/18 |
| 4,496,172 | 1/1985 | Walker | 285/18 |
| 4,509,594 | 4/1985 | Milberger et al. | 166/208 |
| 4,569,404 | 2/1986 | Milberger et al. | 175/208 |
| 4,597,448 | 7/1986 | Baugh | 166/348 |
| 4,607,865 | 8/1986 | Hughes | 285/18 |
| 4,730,851 | 3/1988 | Watts | 285/4 |
| 4,757,860 | 7/1988 | Reimert | 166/108 |
| 4,773,477 | 9/1988 | Putch | 166/206 |
| 4,836,579 | 6/1989 | Wester et al. | 166/86.1 X |
| 4,844,510 | 7/1989 | Theiss et al. | 285/18 |
| 4,989,902 | 2/1991 | Putch | 285/18 |
| 5,026,097 | 6/1991 | Reimert | 166/348 X |
| 5,127,478 | 7/1992 | Miller | 166/348 |

FOREIGN PATENT DOCUMENTS

| | | | |
|---|---|---|---|
| 0261909 | 3/1988 | European Pat. Off. | E21B 33/043 |
| 2129852 | 5/1984 | United Kingdom . | |
| 2156404 | 10/1985 | United Kingdom . | |

OTHER PUBLICATIONS

Cooper Industries (Cooper Oil Tool Division) "Spooltree" Subsea Production System; May 1993; (4 p.).

*Primary Examiner*—William P. Neuder
*Attorney, Agent, or Firm*—Conley, Rose & Tayon, P.C.

[57] ABSTRACT

A hanger suspension system includes an inner casing hanger having an outer circumferential surface with at least three sets of at least three longitudinally spaced outwardly projecting load bearing members azimuthally spaced about the outer circumferential surface and separated by linear flow passages. A hanger assembly is positioned on each set of bearing members and is axially slidable on the outer circumferential surface of the hanger. Each hanger assembly includes a plurality of longitudinally spaced arcuate members having inwardly extending load bearing shoulders for engaging the load bearing members of the inner hanger. The hanger suspension system also includes an outer head having a non-restrictive bore with annular recesses which include load bearing surfaces and camming surfaces. The arcuate members of the hanger assembly include outwardly extending load bearing shoulders for engaging the load bearing surfaces of the outer head and outwardly extending camming shoulders for engaging the camming surfaces in the annular recesses of the outer head. The hanger assembly also includes a trigger member for releasing the bearing member upon alignment with the outer head and includes a deformable alignment tang for locating the recesses in the outer head. The load bearing members on the inner hanger bear against the arcuate members so as to maintain the arcuate members in engagement with the load bearing surfaces of the outer head. The suspension of the inner hanger within the outer hanger is repeatable so as to allow the reciprocation of the inner casing string within the outer casing string during the cementing operation.

10 Claims, 12 Drawing Sheets

HANGER SUSPENSION SYSTEM

FIELD OF THE INVENTION

This invention relates generally to suspension systems for suspending concentric strings of pipe within an oil and gas well and, more particularly, relates to a casing hanger for supporting an inner casing string within an outer casing string at an offshore well and still more particularly, but not exclusively, to casing hanger systems for supporting casing strings at the mudline of the ocean floor.

BACKGROUND OF THE INVENTION

With the advent of offshore drilling in order to produce petroleum products from production zones located beneath bodies of water, it has become desirable to provide casing hanger systems that are adapted to be positioned at or near the bottom of the body of water. These hanger systems are typically known as mudline suspension systems. Mudline suspension systems use an outermost casing hanger which suspends a coaxial series of concentric casing strings such that their combined weight is suspended at the mudline. This allows the drilling rig to operate in deeper than normal waters, and provides for disconnection and removal of equipment above the mudline when the drilling rig moves from one drilling location to another drilling location or when the driller moves away from the well and subsequently re-establishes a well drilling connection when it is desirable to continue drilling operations. By locating suspension systems at or near the ocean floor, a temporarily abandoned well or capped well does not present an obstruction that typically interferes with the marine environment. Such suspension systems also enable the driller to complete wells by means of an ocean floor completion or extend the casing to the surface for completion on a drilling ship or platform and subsequently lends a degree of flexibility in completion systems that renders such casing hanger systems desirable.

In mudline suspension systems, concentric casing strings are hung and cemented in place as the drilling progresses to increasing depths. Typical diameters for various casing strings are 30", 20", 16", 13⅜", 9⅝" and 7". When drilling a subsea well from a fixed platform, it is desirable to support the casing weights from the mudline with a blowout preventer located at the platform. Risers extend from the blowout preventer to the support location and are of substantially the same size as the casing string itself. The riser may be several hundred feet long and is made up of successive riser pipes whose adjacent ends are connected at the water's surface as the riser is lowered into position, or disconnected as the riser is raised. Each of a plurality of inner casing strings is lowered into a bore drilled in the ocean floor by means of a hanger connected to the riser. When the hanger is landed within the hanger from which the next outer casing string is suspended, cement is pumped and circulated down through the flowbore of the riser, hanger and suspended string, around the terminal end of the string, and up into the annulus around the suspended string, to anchor it in place. It is necessary that the cement pass between the adjacent hangers of the inner and outer casing strings. When the well has been tested, the riser may be retrieved, and the hangers at the upper ends of the casing strings capped or closed off at the ocean floor to permit the drilling rig to be moved to another location. When it is desired to complete the well for production purposes, the cap is removed and risers are lowered into connection with at least the innermost suspended casing strings to tie them back to a production platform at the surface of the water. The successive hangers are supported on one another so that the load of all of the hangers and the casing supported from the hangers is supported by a seat in the bore of the outermost casing hanger.

The casing hangers are connected to the upper ends of successively smaller diameter casing strings which are adapted to be lowered into and landed within the bore of a casing hanger which is connected to an outermost casing string at the mudline in order to suspend the strings within the outermost casing of the wellbore. The annular space, commonly called an annulus, between an outer casing string and the next inner casing string permits cement returns to circulate therethrough as the string is cemented within the wellbore, or adapted to be closed off, when the casing has been cemented. Casing strings of a large diameter, as for example, 16", 20" or 30", have sufficient annular space to allow the use of solid hangers, normally in the form of an annular landing shoulder on the outer casing hanger, which in turn, suspends an inner casing hanger having an annular support shoulder. Such shoulders typically have a bypass or flute therethrough to connect the annulus above and below the hangers for the circulation of cement returns.

Casing strings of a smaller diameter severely limit the annular space by which to support the next inner-casing hanger and also allow adequate flow passages therebetween for the circulation of cement returns. Because the annular spaces between the inner-most casing strings are much smaller, typically the hangers are provided with support members which are withdrawn or retracted until the string is lowered into the wellbore to dispose the support members opposite the landing member on the next outer hanger. Thus, in smaller strings, there is more limited annular space available for support and the support must be arranged in such a way as to permit flow through the annular space to facilitate cementing operations.

One prior art type of hanger includes a support member having a circumferentially split ring which is contractible within a recess in the outer surface of the inner hanger body as the string is being lowered, and which has a landing surface on its lower end which, when the string has been so lowered, expands outwardly into a supported position on a landing member in the form of an upwardly facing seat extending radially inward from the bore of the outer hanger of the next outer casing string. However, in order to support the weight of the casing string, the expandable rings must have relatively large support surfaces, which of course require landing surfaces on the next outer hangers of equally large radial extent. As a consequence, in order for the hanger bodies to be thick enough to withstand pressure differences between the casing strings, it has heretofore been thought necessary, in apparatus of this type, to vertically stagger the expandable support ring and landing surface on at least some of the hangers. This in turn has increased the height of each such hanger and thus the size and cost of the suspension system.

In another system of the prior art, the inner casing hanger with its string of casing includes a diametrically compressible collet which is urged outwardly. The collet includes specially-shaped support shoulders extending outwardly which engage grooves in the previously-set outer hanger. The inner casing hanger then rests on this collet. Means such as shear pins are required to carry the collet on the inner casing hanger at least until it enters the casing below the blowout preventer and sometimes to pull the collet down until it reaches the support elevation. Other systems use the load support shoulder to push the collet down after means are provided to constrain the collet until it enters the outer casing string.

In another embodiment of the prior art, the inner and outer casing strings are connected together by means of a resilient expandable and contractible locking support element mounted on the inner casing hanger which is biased radially outwardly but free to expand and contract radially until it engages a mating profile in the outer casing string. After engagement, a releasable means permits the locking support element to move axially with respect to the inner casing hanger to a locked expanded position and support the weight of the inner casing string on the outer casing string. By providing two or more coacting load bearing shoulders between the inner casing string and the locking support element and two or more coacting load bearing shoulders between the outer casing string and the locking support element, a greater area of load bearing surfaces is provided in a limited annular space. Longitudinal slots are provided in the locking support element for the by-pass of fluid flow.

The above prior art designs present a considerable restriction to flow during cementing. The arrangement of these prior art suspension systems, such as a contractible split ring, compressible collet, or other contractible locking support element, forces the fluid to flow through a tortuous path through expensive milled slots. Further, as wells approach greater depths, the innermost hangers must carry increased load thus requiring larger support surfaces thereby further reducing available space.

Typically, in the above prior art designs, the load carrying member also serves as the triggering mechanism. This results in these members having to resist considerable bending stresses, a condition which precludes manufacturing the suspension system by casting. Castings invariably have some porosity which makes their resistance to bending less reliable than if the parts in the suspension system are forged or machined from bar stock.

These prior art suspension members also occupy a larger portion of the latch profile such that debris and drilling mud filter cake can accumulate in the latch profile and greatly impair the latching process. The support members which enter the profiles of the previously run outer casing hanger must be fully engageable despite any mud that may have previously accumulated in the profiles. The restriction of the annular space between the innermost casing hangers further encourages the accumulation of debris and drilling mud in the profiles.

The limited annular space between casing strings of a relatively smaller diameter is of particular concern when deep wells are drilled which deviate from vertical. A casing hanger for suspending an inner casing string of a relatively small diameter may suspend 10,000 to 15,000 feet of casing weighing approximately one million pounds. Previously, in vertical wells, the smaller casing strings were often rotated to assist the cement in completely filling the annulus. However, in strings of 10,000 to 15,000 feet, the inner casing string cannot be rotated to assist in causing the cement to fill the annulus in a deviated well. Although not recommended, many operators reciprocate the inner casing string to assist in completely filling the annulus with cement. To allow reciprocation, it is necessary to have a casing hanger which does not require rotation to suspend the inner casing hanger within the outer casing hanger. In particular, the inner casing hanger must not be latched down or locked down such that the casing string may be reciprocated. Further, the act of suspending the inner casing hanger within the outer casing hanger must be repeatable to allow for the initial suspension, the subsequent reciprocation, and then a final suspension after the cementing operation has been completed.

The present invention overcomes the deficiencies of the prior art.

SUMMARY OF THE INVENTION

The hanger suspension system of the present invention includes an inner casing hanger on an inner casing string suspended to and from an outer casing head on an outer casing string. The inner hanger includes an outer circumferential surface having at least three sets of at least three longitudinally spaced outwardly projecting load bearing members azimuthally spaced about the outer circumferential surface and separated by linear flow passages. A hanger assembly is positioned on each set of bearing members and is axially slidable on the outer circumferential surface of the hanger. Each hanger assembly includes a plurality of longitudinally spaced arcuate members having inwardly extending load bearing shoulders and outwardly extending load bearing shoulders. The arcuate members further include outwardly extending camming shoulders.

The outer head has a non-restrictive bore with annular recesses which include load bearing surfaces and camming surfaces. Each hanger assembly further includes a trigger member mounted on the arcuate members for locating the annular recesses on the outer head and releasing the arcuate members on the hanger assembly whereby the outwardly extending load bearing shoulders engage the load bearing surfaces in the recesses. The trigger member includes a deformable alignment tang for being deformably received within a locator recess adjacent said recesses in the outer head. Springs are provided between the arcuate members and trigger member to bias the trigger member outwardly and into the recesses of the outer head. The load bearing members on the inner hanger bear against the arcuate members so as to maintain the arcuate members into engagement with the load bearing surfaces of the outer head.

The present invention is particularly useful during the cementing of the inner casing string within the outer casing string. Once the inner hanger is suspended within the outer head by engaging the inwardly and outwardly extending load bearing shoulders on the arcuate members with the load bearing members of the hanger and load bearing surfaces of the head, respectively, cement is pumped down the flow bore of the inner casing string and up the annulus formed by the inner and outer strings. To assist the flow of the cement around the inner casing string, the hanger and inner casing string is lifted from the load bearing surfaces on the outer head by cammingly engaging the outwardly extending camming shoulders of the arcuate members with the camming surfaces on the outer head. This causes the arcuate members to contract and allow the inner casing string to be raised and lowered with respect to the outer casing string to cause the cement to flow around the outer circumference of the inner casing string and completely fall any voids in the annulus around the inner casing string. Prior to the cement setting up, the inner hanger is again suspended on the outer hanger by lowering the hanger and inner casing string to allow the outwardly extending load bearing shoulders on the arcuate members to reengage the load bearing surfaces in the recesses of the outer head. The cement is then allowed to set.

Still other and further objects, features and advantages will be apparent from the following description of presently preferred embodiments of the invention, given for the purpose of disclosure and taken in conjunction with the accompanying drawings.

BRIEF DESCRIPTION OF THE DRAWINGS

In order that the manner in which the above-recited advantages and features of the present invention are attained and can be understood in detail, more particular description of the invention, briefly summarized above, may be had by reference to the specific embodiments thereof that are illustrated in the appended drawings, which drawings form a part of this specification. It is to be understood, however, that the appended drawings illustrate only typical embodiments of this invention, and therefore are not to be considered limiting of the scope of the present invention, for the invention may admit to other equally effective embodiments. In the drawings, like reference characters are used throughout to designate like parts.

DESCRIPTION OF PREFERRED EMBODIMENTS

The suspension system of the present invention may be used in a variety of different types of wells being drilled for the production of oil and gas. The suspension system is particularly adapted for use in drilling offshore oil and gas wells. The preferred use of the suspension system of the present invention is for suspending concentric strings of casing within an offshore oil and gas well at the mudline of the ocean floor. Although the present invention will be described for the installation of a mudline suspension system for an offshore oil and gas well, it should be appreciated that the suspension system of the present invention is not limited to use in such an installation.

Figure 1:
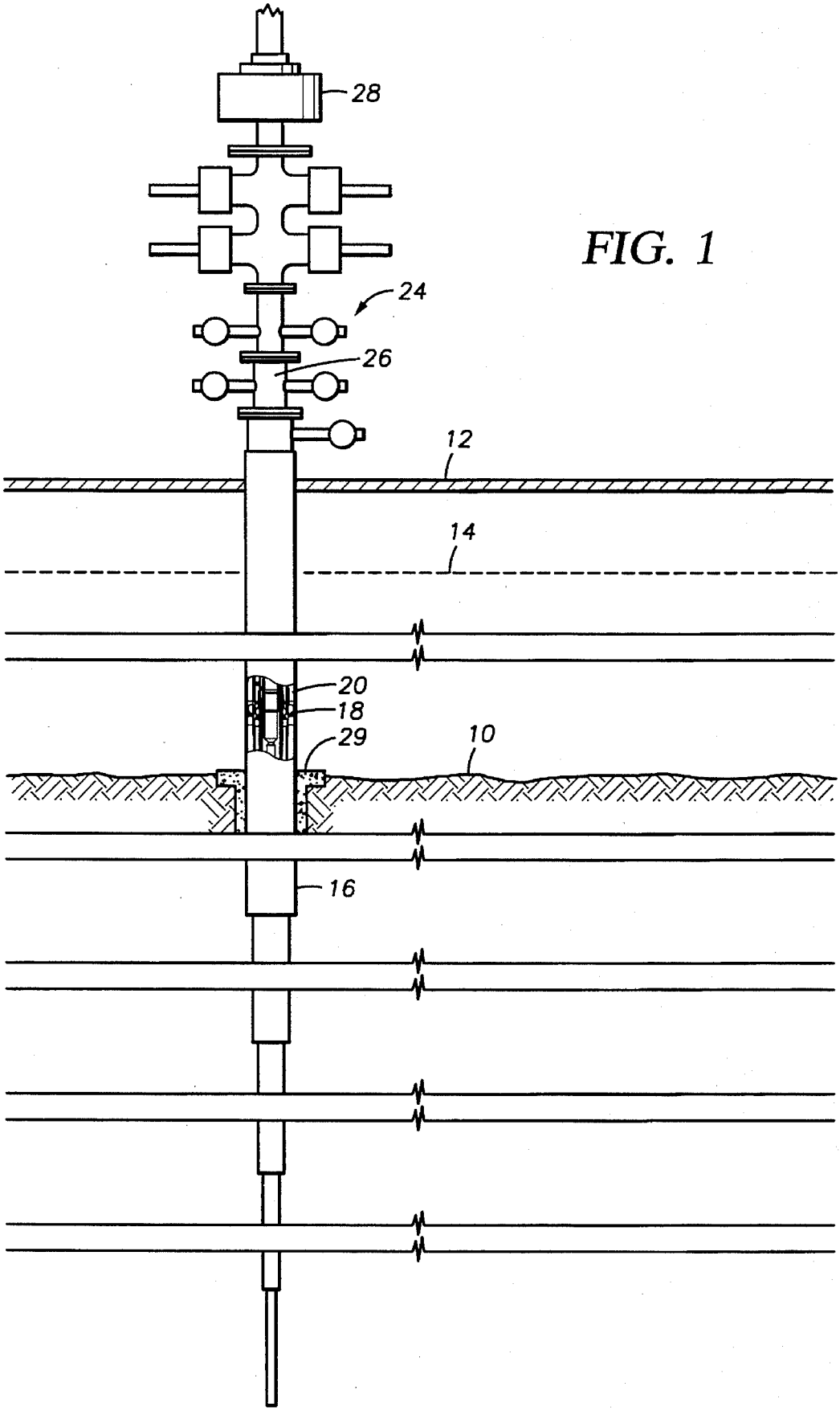
FIG. 1 is a diagrammatic illustration of an offshore well having a plurality of concentric strings of casing suspended at the mudline, the casing suspension system being broken away in part to show the outermost casing hanger suspending concentric strings of casing therefrom.

Referring initially to FIG. 1, there is shown an offshore oil and gas well being drilled into the ocean floor 10 from a ship or platform 12 located at the water's surface 14. FIG. 1 is a diagrammatic illustration of a typical installation of a mudline suspension system for suspending a plurality of concentric casing strings at the ocean floor 10. As is well known in the art, a plurality of casing strings are suspended within successively smaller diameter bores drilled into the ocean floor 10.

Figure 2:
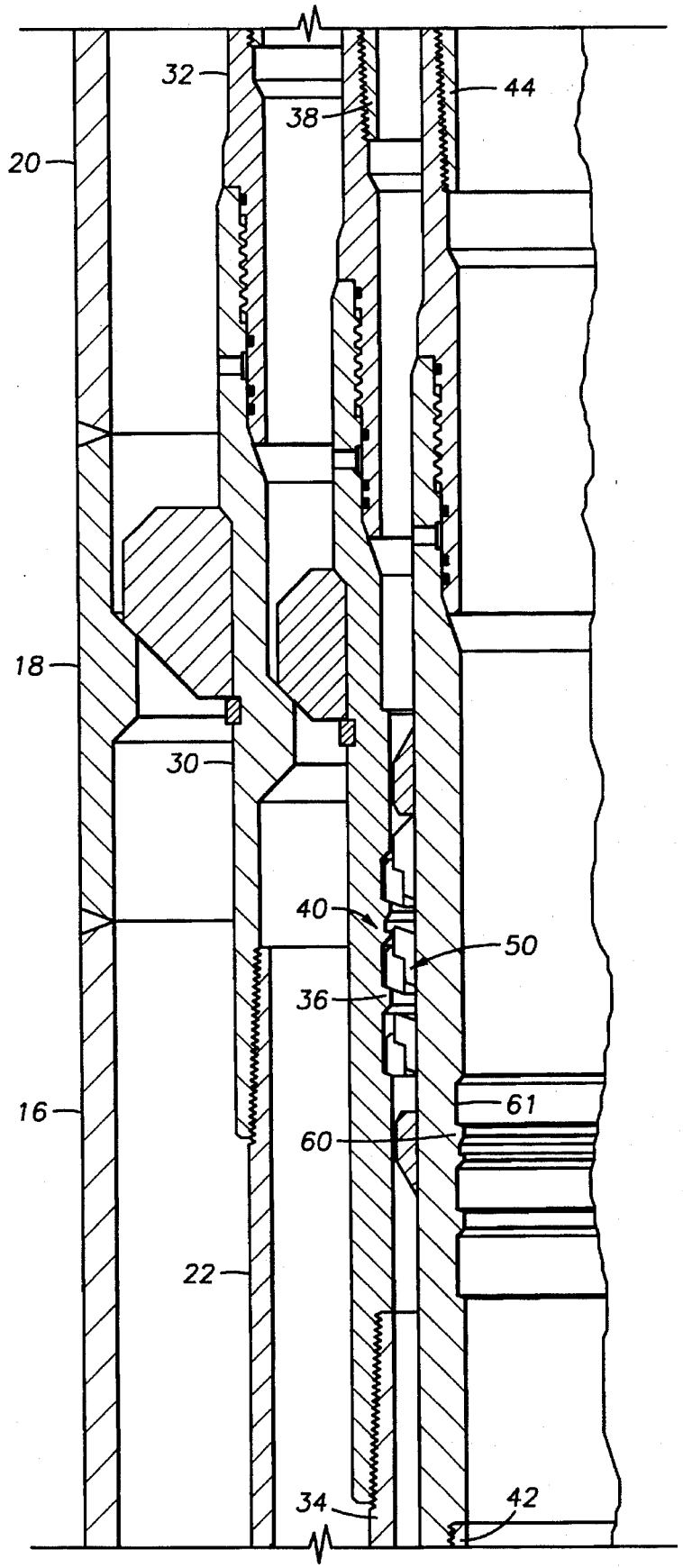
FIG. 2 is a vertical sectional view of one-half of an inner casing hanger, utilizing the suspension system of the present invention, in the landed position within the next outer casing hanger.

Referring now to FIGS. 1 and 2, initially, a conductor casing string 16, typically 30 inches in diameter, with a casing hanger 11 are lowered on a conductor riser 20 from the drilling platform 12 and are driven or jetted into the ocean floor 10 until casing hanger 18 rests near the ocean floor 10. Casing hanger 18 is provided with a landing shoulder for interiorly supporting a surface casing string 22. As is well known in the art, pressure control equipment 24 is mounted on the platform 12 and includes a wellhead 26 to which the upper end of riser 20 is connected. A blowout preventer stack 28 is installed above the wellhead 26. As is also well known in the art, the suspended casing strings are anchored within the well bores by means of columns of cement 29 which, as will be explained hereinafter, may extend upwardly into the annular space formed between the concentric casing strings.

After the conductor casing string 16 is installed, a borehole is drilled for the surface casing string 22, typically having a diameter of 16 or 20 inches. Surface casing string 22 is lowered into place with a surface casing hanger 30 on a surface casing riser 32. The surface casing hanger 30 includes an annular support shoulder which is supported by the landing shoulder on conductor casing hanger 18. The surface casing 22 is then cemented in place. Casing hanger 30 also includes an inner landing shoulder for supporting intermediate casing string 34.

A borehole is then drilled for the intermediate casing string 34, typically having a 13⅜ inch diameter. Intermediate casing string 34 and intermediate casing hanger 36 are lowered on intermediate riser 38 with an annular stop shoulder on intermediate casing hanger 36 engaging the landing shoulder on outer surface casing hanger 30. The intermediate casing string is then cemented in place. The intermediate casing hanger 36 includes a profile 40 which receives a hanger assembly 50 mounted on a production casing hanger 60 for supporting a production casing string 42.

The borehole for production casing string 42 is then drilled and the production string 42, typically 9⅝" in diameter, and production casing hanger 60 are lowered on production casing riser 44 until the hanger assembly 60 engages profile 40, as hereinafter described in further detail. Although not shown, another borehole may be drilled for an innermost casing string, typically 7 inches in diameter, for suspending another casing string within the production casing string 42 such as on profile 61.

It should be appreciated that each of the hangers 18, 30, 36, and 60 not only serves as a hanger for suspending casing strings 16, 22, 34 and 42, respectively, but also serves as a casing head for supporting inner casing hangers and casing strings. Where casing hangers 18, 30, 36, and 60 are serving as a casing head, they may be referred to as a casing head rather than a casing hanger.

During the drilling of each borehole, the mud returns flow upwardly in the annulus formed between the drill string and the next outer casing string and riser. After each successively smaller diameter wellbore is drilled, the casing string, which is to line that wellbore, is cemented into place. The annulus serves as a means for returning drilling mud to the pressure control apparatus on the drilling rig at the platform 12 and for flowing cement into the well. Each of the hangers 18, 30, and 36 have flow passages (not shown) for communicating the annulus above and below the hanger to the flow of drilling mud and cement returns such that when the hanger is landed at the mudline, the drilling mud and cement returns may pass upwardly therethrough. These and other practices are well known in the art, and therefore form no part of the present invention and consequently require no further detailed description.

The larger casing strings, such as conductor casing 16 and surface casing 22, have sufficient annular space therebetween to permit flow passages through the landing and support shoulders for allowing an adequate circulation of drilling mud and cement returns through the annulus. The mudline casing hanger system of the present invention is particularly directed to suspension systems for casing strings of a relatively smaller diameter such as for supporting a production casing string within an intermediate casing string. The diameters forming the annular space between these casing strings severely restrict the space allowed to form bypasses or flutes through the hangers to allow for the adequate circulation of drilling mud and cement returns. The mudline casing hanger system of the present invention is particularly directed to casing hangers of this diameter or smaller and thus the invention, for purposes of illustration, will be described in suspending a production casing string within an intermediate casing string. However, it should be understood that the mudline casing hanger system of the present invention may also be used in the suspension of other sized casing strings and in particular, smaller diameter strings as for example an innermost casing string such as a seven inch casing string.

Figure 3:
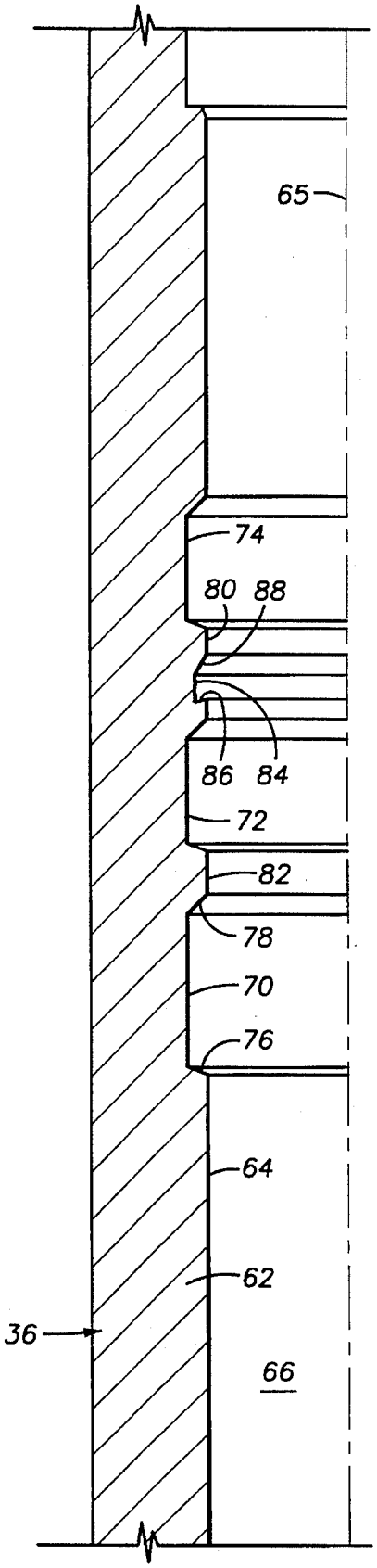
FIG. 3 is an enlarged view of the profile of the outer casing head shown in FIG. 2.

Referring now to FIG. 3, there is shown an enlarged view of the profile 40 of outer intermediate casing head 36. Outer casing head 36 includes a tubular body 62 having an inner cylindrical wall 64 forming a non-restrictive flow bore 66. The inner cylindrical wall 64 forms the inner diameter of casing head 36. Profile 40 is formed by a plurality of recessed circumferential grooves in cylindrical wall 64 including a lower annular groove 70, a medial groove 72, and a upper groove 74. Each of the grooves 70, 72, 74 form an upwardly facing, downwardly tapering frusto-conical bearing surface 76 and a downwardly facing, upwardly tapering frusto-conical camming surface 78. Lower bearing surface 76 tapers approximately 20° from horizontal and upper camming surface 78 tapers approximately 45° from horizontal, horizontal being perpendicular to the longitudinal flow axis 65 of outer casing head 36. Medial and upper annular grooves 72, 74 form an annular segment 80 therebetween and medial and lower annular grooves 72, 70 form a lower annular segment 82 therebetween. Upper annular segment 80 includes an annular locator recess 84 forming an upwardly facing and upwardly tapering arcuate locator surface 86 and a downwardly facing and upwardly tapering arcuate camming surface 88. Locator surface 86 has a taper of 15° with horizontal and upper camming surface 88 has taper of approximately 30° from the longitudinal direction, i.e. the flow axis 65.

Figure 4A:
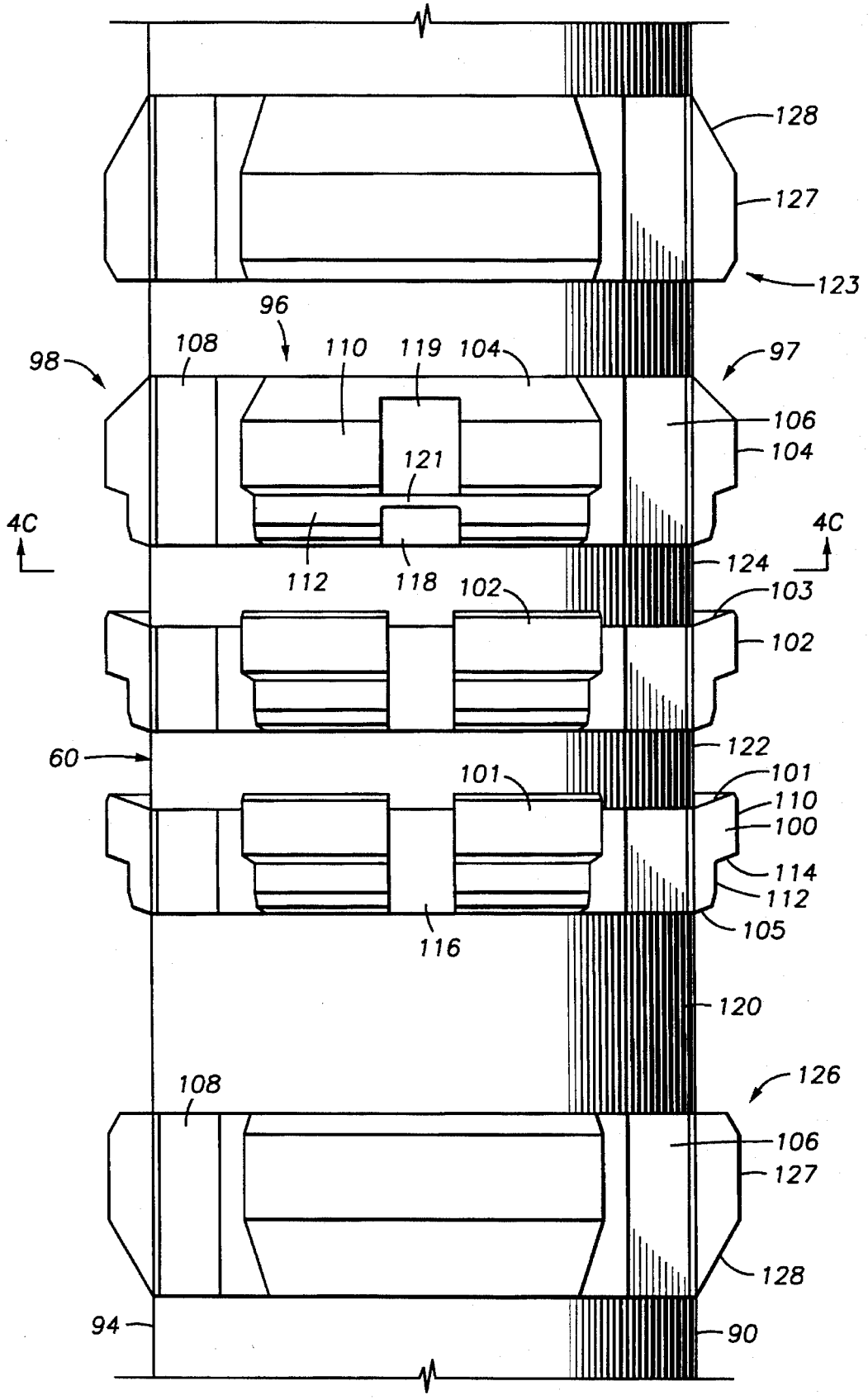
FIG. 4A is a perspective view of the hanger body inner casing hanger shown in FIG. 2.
Figure 4B:
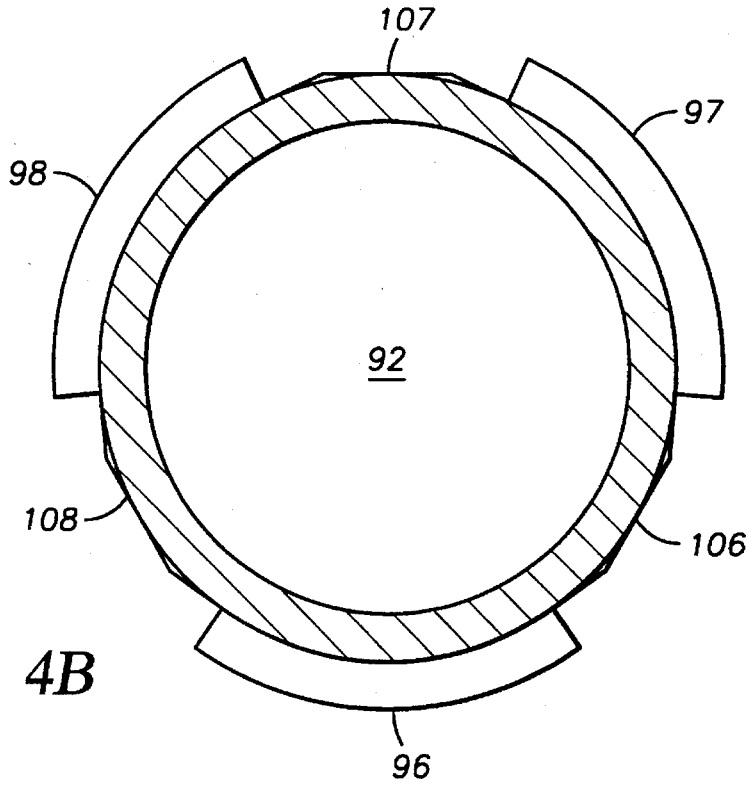
FIG. 4B is a top view of the inner casing hanger body of FIG. 4A.
Figure 4C:
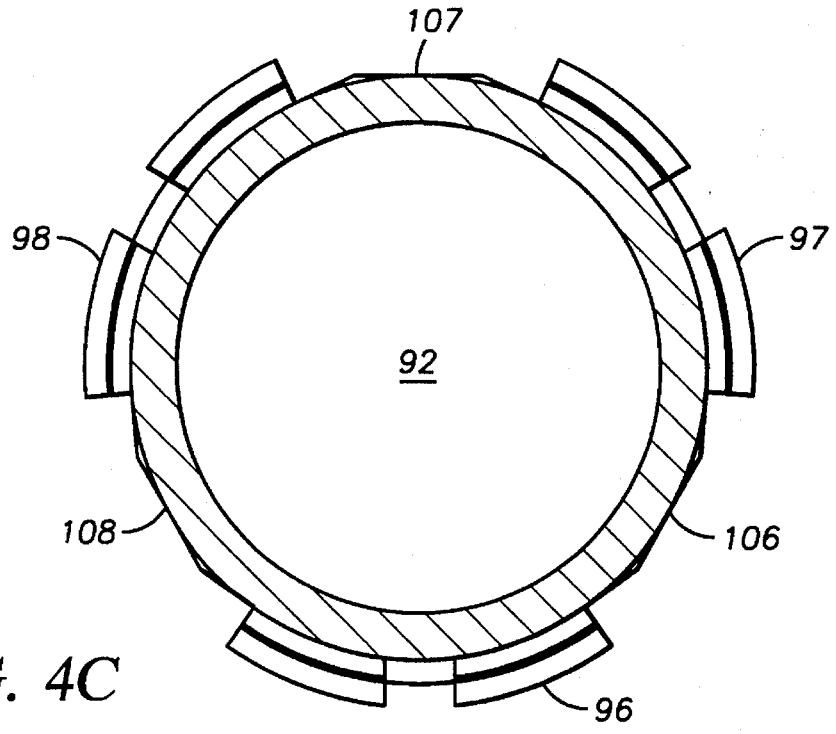
FIG. 4C is a section view taken through plane C—C in FIG. 4A.

Referring now to FIGS. 4A, B, and C, there is shown the hanger body 90 of inner production casing hanger 60. Hanger body 90 is a generally cylindrical member forming a flow bore 92 therethrough and an outer cylindrical surface 94 forming the outer diameter of body 90. Three sets 96, 97, and 98 of three load bearing members or lugs 100, 102, 104 are milled into the hanger body 90 thereby forming outer surface 94. Each of the three sets of lugs 96, 97, 98 are separated by longitudinal, linear flow passages or channels 106, 107, 108. Linear flow passages 106, 107, 108 are generally straight and parallel to the flow axis 65 and have radial boundaries formed by the inner diameter of hanger 60 and the outer diameter of head 36. This provides a maximum radial width to flow passages 106, 107, 108 for the circulation of drilling fluids and cement returns. Since each of the three sets 96, 97, 98 of lugs 100, 102, 104 are the same, a description of one lug set will be illustrative of the description of the other lug sets.

Each of the lugs 100, 102, 104 include an outer arcuate, longitudinal bearing surface 110 and an inner arcuate longitudinal bearing surface 112 extending below outer arcuate bearing surface 110. An arcuate, downwardly facing upwardly tapering load bearing member 114 is formed by the transition between the diameters of outer surface 110 and inner surface 112. A longitudinal channel 116 extends through the mid section of lower lug 100 and intermediate lug 102. Channel 116 extends into upper lug 104 forming an expanded flat 118 in inner surface 112 and an expanded flat 119 in outer surface 110. The channel 116 at expanded flat 119 has a smaller depth, i.e. radius, than channel 116 at expanded flat 118, thus forming a step 121 between flats 118, 119. Annular horizontal recesses 120, 122, 124 are formed below each of the lugs 100, 102, 104, respectively, for receiving a hanger assembly 125 including a cage 130, trigger 170 and trigger guard 200 hereinafter described (See FIG. 9). Lower lug 100 and intermediate lug 102 include upwardly facing, upwardly tapering frusto-conical surfaces 101, 103, respectively, for supporting hanger assembly 125. Each of the lugs 100, 102, 104 have downwardly facing, upwardly tapered lower terminal surfaces 105 for engaging hanger assembly 125 as hereinafter described.

The inner casing hanger 60 is provided with upper and lower sets 123,126, respectively, of centralization lugs 127 having a tapered surface 128. Channels 106, 107, 108 separate each of the lugs 127. Centralization lugs 127 centralize inner casing hanger 60 within outer casing hanger 36 and also provide protection for the three sets of hanger assemblies 125 as inner casing hanger 60 is lowered or raised within the bore 66 of outer casing hanger 36. The tapered surfaces 128 of centralization lugs 127 assist in the centralization of inner casing hanger 60 within outer casing hanger 36.

Figure 5A:
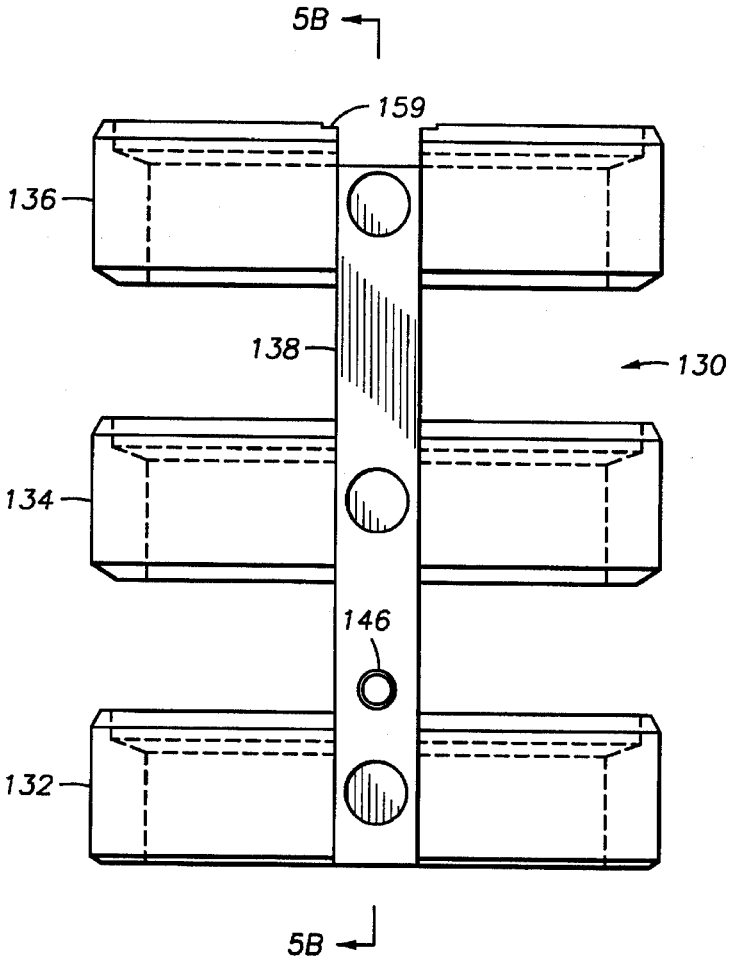
FIG. 5A is a perspective view of the cage to be mounted on the inner casing hanger body of FIG. 4 as part of the hanger assembly.
Figure 5B:
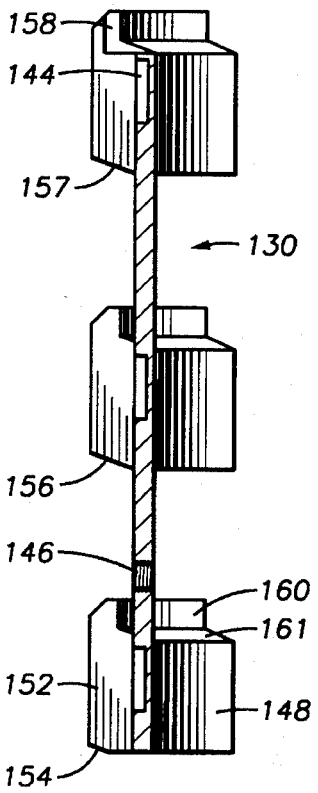
FIG. 5B is a section view taken through plane B—B in FIG. 5A.
Figure 5C:
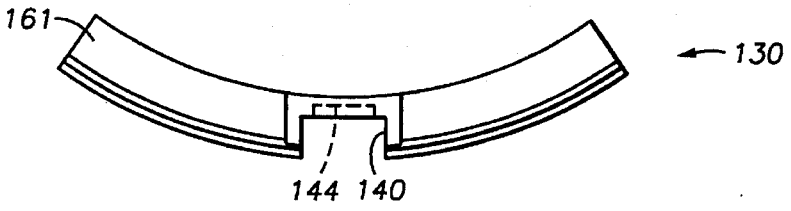
FIG. 5C is a top view of the cage shown in FIG. 5A.

Referring now to FIGS. 5A, B, and C, there is shown a cage 130 formed by a set of three arcuate support members or dogs 132, 134, and 136 attached by a transverse longitudinal member 138. A cage 130 is mounted, as hereinafter described in further detail, on each of the three lug sets 96, 97 and 98 on hanger body 90. The three dogs 132, 134, 136 and transverse member 138 are investment cast. A longitudinal channel 140 is provided through the center of dogs 132, 134 and 136 and three blind bores 144 are provided in the outer surface of longitudinal member 138 in alignment with the center line of each of the dogs 132, 134, 136 for housing one end of a biasing member or spring 150, hereinafter described with respect to FIG. 7. Further, a threaded bore 146 is provided through longitudinal member 138 above lower dog 132 for assembly purposes, as hereinafter described.

Since each of the dogs 132,134, 136 is substantially the same, a description of lower dog 132 will also describe the other two dogs 134, 136. Lower dog 132 is an arcuate segment having an inner arcuate bearing surface 148 and an outer arcuate bearing surface 152. The radius of inner arcuate surface 148 conforms to the radius of the wall 94 of hanger body 90. The thickness of arcuate dog 132 is less than the difference in radius between the inside diameter and outer diameter of outer casing head 36 and the inner casing hanger 60 respectively. The outer bottom arcuate comer of dog 132 is chamfered at 154 while the downwardly facing bottom surfaces 156, 157 of dogs 134, 136 respectively are tapered upwardly and outwardly for supporting engagement with upwardly facing surfaces 101,103 of lugs 100, 102 respectively. Each dog 132 includes an arcuate notch 160 on the upper inner surface 148 forming an upwardly facing bearing surface 161. An expanded notch 158 is coaxial with channel 140 to form a pair of inwardly directed flanges 159 for engagement with ears 182, 183 on trigger 170, as hereinafter described.

Figure 6B:
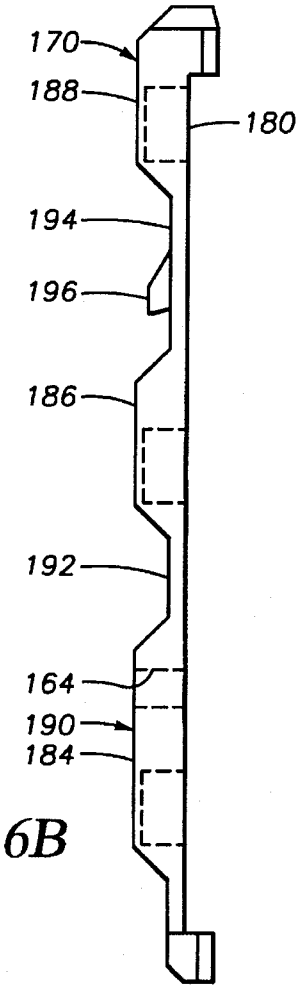
FIG. 6B is a side elevation view of the trigger shown in FIG. 6A.
Figure 6A:
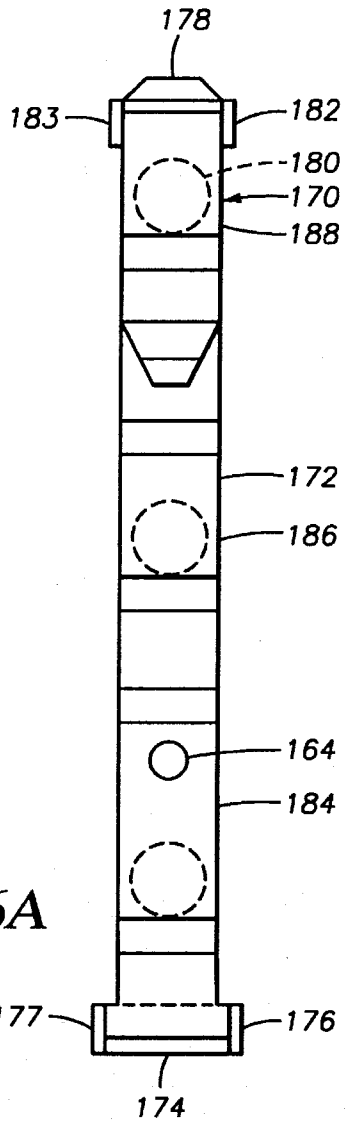
FIG. 6A is an elevation view of the trigger to be assembled with the cage shown in FIG. 5 to form the hanger assembly.

Referring now to FIGS. 6A and B, there is shown a trigger 170 to be mounted on each of the three cages 130, as hereinafter described in further detail. Trigger 170 has an elongated body 172 sized to be received within the vertical channel 140 of each cage 130. The lower terminal end 174 includes horizontal projecting ears 176, 177 projecting from each side thereof. Likewise, the upper terminal end 178 of elongated body 172 also includes horizontally projecting ears 182, 183. Three blind bores 180 are provided in the inner side of elongated body 172 for alignment with blind bores 144 on cage 130 so as to receive the other end of springs 150 shown in FIG. 7.

Referring particularly to FIG. 6B, the outer surface of trigger 170 includes a profile 190 configured and dimensioned such that profile 190 may be received within profile 40 on outer casing hanger 36. In particular, trigger 170 includes a lower projecting portion 184, an intermediate projecting portion 186, and an upper projecting portion 188 to be received within annular grooves 70, 72, and 74, respectively, of profile 40 on hanger 36. A slot 192 is formed between portions 184, 186 and a slot 194 is formed between portions 186, 188 for receiving segments 82, 80, respectively, on profile 40. An aperture 164 is provided through portion 184 for assembly purposes in conjunction with threaded bore 146 as hereinafter described.

Trigger 170 includes a projecting, deformable, alignment member or button such as a tang 196 which projects from the base of slot 194. Tang 196 has a generally triangular bearing surface which may have a truncated apex such as 197 or a pointed apex. The apex 197 extends approximately 0.020 inches below upwardly facing and upwardly tapering arcuate shoulder 86 formed by annular recess 84 in annular segment 80 of profile 40 on outer casing hanger 36. The apex 197 of tang 196 is adapted to deform upon the misalignment of trigger 170 with profile 40 so as to ensure that the dogs 132, 134, 136 are received within annular grooves 70, 72, 74 forming profile 40 on outer casing head 36. Tang 196 avoids the requirement of stringent tolerances in the alignment of dogs 132, 134, 136 with annular grooves 70, 72, 74, respectively.

Figure 7:
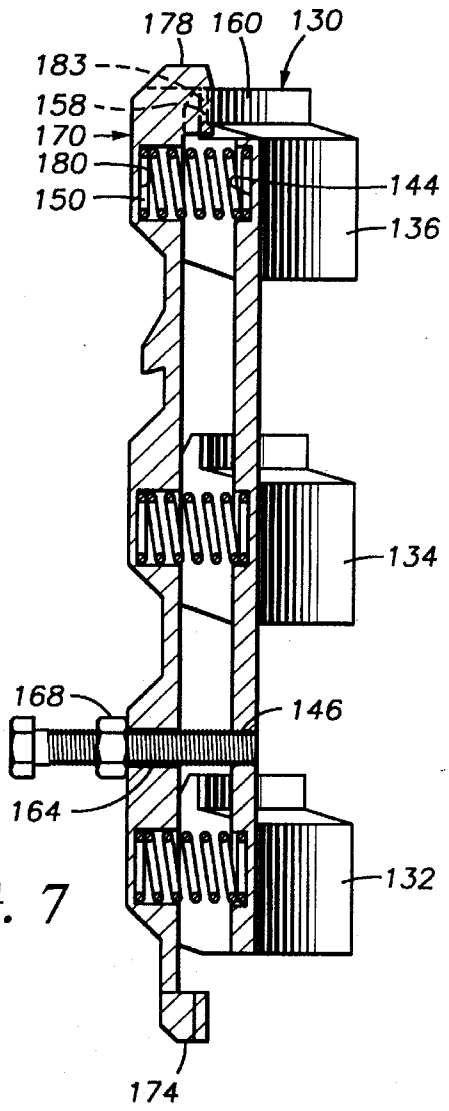
FIG. 7 is a side elevation view in cross-section of the trigger of FIG. 6 assembled to the cage of FIG. 5.

;Referring now to FIG. 7, the trigger 170 is mounted on cage 130 by sliding ears 182, 183 at the upper terminal end 178 of trigger 170 into expanded notch 158 of upper dog 136 behind flanges 159. Springs 150 are received within each of the aligned blind bores 180 in trigger 170 and blind bores 144 in member 138 of cage 130. As trigger 170 is received within channel 140, each of the springs 150 is compressed so as to bias trigger 170 outwardly. An installation bolt 168 is received through aperture 164 and threaded into threaded bore 146 of cage 130 to maintain trigger 170 and cage 130 in the assembled position.

Figure 8A:
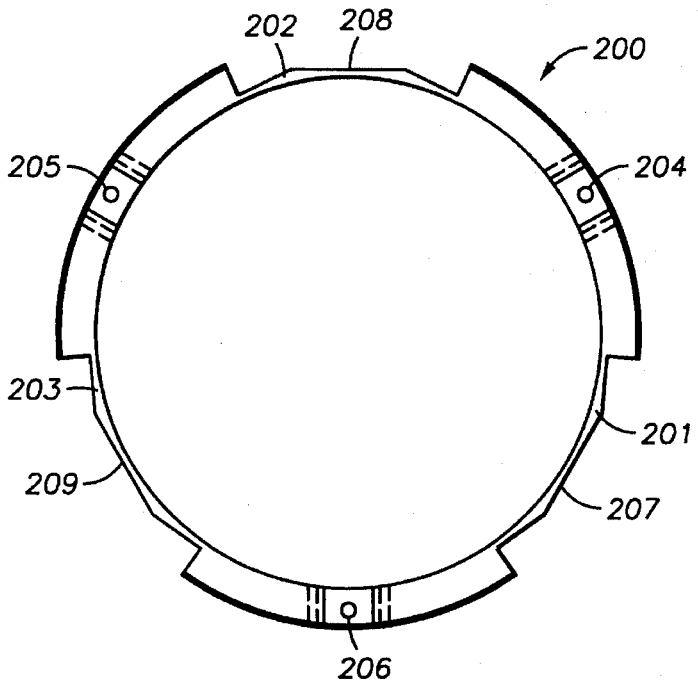
FIG. 8A is a plan view of the trigger guard for the hanger assembly shown in FIG. 7.
Figure 8B:
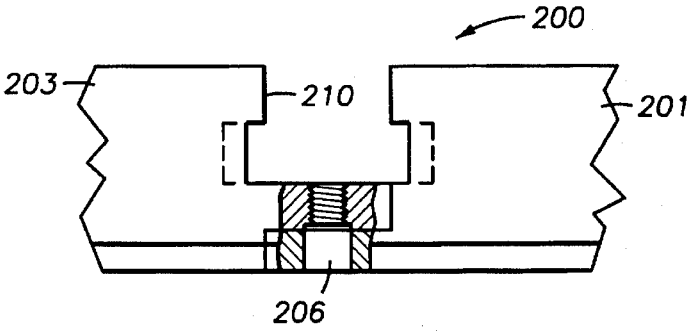
FIG. 8B is an enlarged view, partly in cross-section, of one of the hinges on the trigger guard of FIG. 8A.

Referring now to FIGS. 8A and B, there is shown a hinged trigger guard 200. Trigger guard 200 includes three hinged sections 201,202, and 203 hinged at 204, 205 and 206. Each of the sections 201,202, 203 includes cut outs 207, 208, 209, respectively, for alignment with flow passages 106, 107, and 108 of hanger body 90. Referring particularly to FIG. 8B, there is shown hinge 206. The terminal ends of segments 203 and 201 forming hinge 206 form a T-slot 210. T-slot 210 is configured and dimensioned to radially, slidably receive ears 176, 177 on the lower terminal end 174 of trigger 170. It should be appreciated that hinge 206 has a construction which is identical to hinges 204 and 205.

It should be appreciated that all components with the exception of hanger body 90 and springs 150 may be cast. The present invention separates the load carrying function from the triggering function such that the external components, with the exception of springs 150, are subjected to compressive loads only. This condition allows the use of casting.

Figure 9:
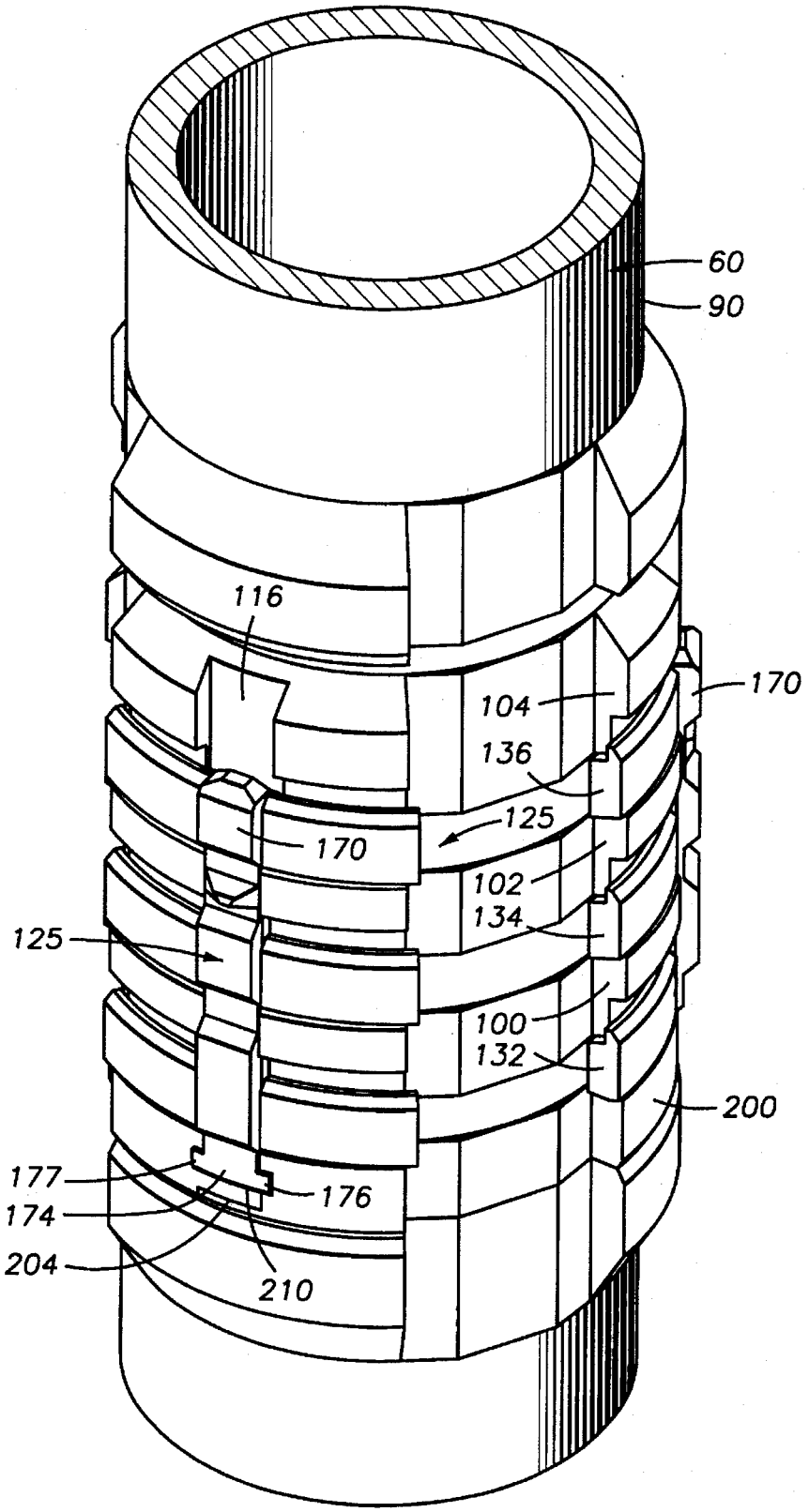
FIG. 9 is a perspective view of the assembled hanger assembly mounted on the inner casing hanger body.

Referring now to FIG. 9, the hanger assemblies 125 are shown mounted on inner casing hanger 60. In assembling hanger assembly 125 on one of the sets of three lugs, the longitudinal member 138 on cage 130 is aligned with vertical channel 116 formed between each of the segments 100, 102, 104. Further, arcuate dogs 132, 134, 136 are received within the slots 120, 122, 124, respectively, on hanger body 90. Upon mounting an assembly of cage 130 and trigger 170 on each of the three sets 96, 97, 98 of segments 100, 102, 104 on hanger body 90, trigger guard 200 is assembled with screws at 204, 205 and 206 around the lower terminal end 174 of triggers 170 to hold cages 130 and trigger 170 in position on hanger body 90. Installation bolts 168 are removed to finalize the installation of hanger assembly 125. As can be appreciated, ears 176, 177 on the lower terminal end 174 of each of the triggers 170 are radially, slidably received within each T-slot 210 at each of the hinges 204, 205,206 of trigger guard 200. The upper terminal end 178 of trigger 170 is adjacent flat 118 of upper segment 104. Hanger assembly 125 is axially, slidably mounted on hanger body 90 of inner hanger 60 and is radially contractible and expansible with respect to hanger body 90 of inner hanger 60.

Referring now to FIGS. 10, 11, and 12, FIG. 10 illustrates the assembly of cage 130 and trigger 170 on hanger 60 in the running position. FIG. 11 illustrates the assembly of cage 130 and trigger 170 on hanger 60 in the location or triggering position. FIG. 12 illustrates the assembly of cage 130 and trigger 170 on hanger 60 in the suspending position.

Figure 10A:
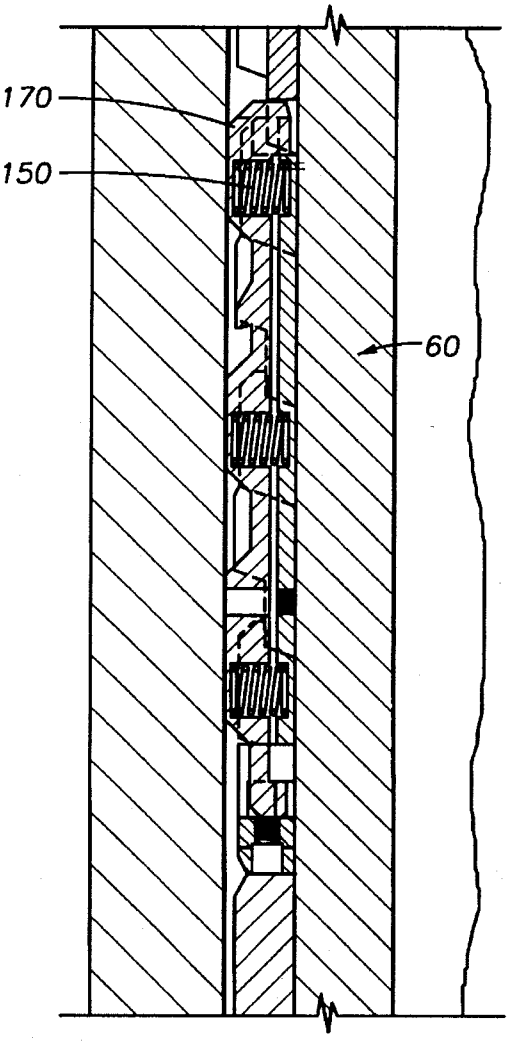
FIG. 10A is a side elevation view in cross-section of the trigger in the running position.
Figure 12B:
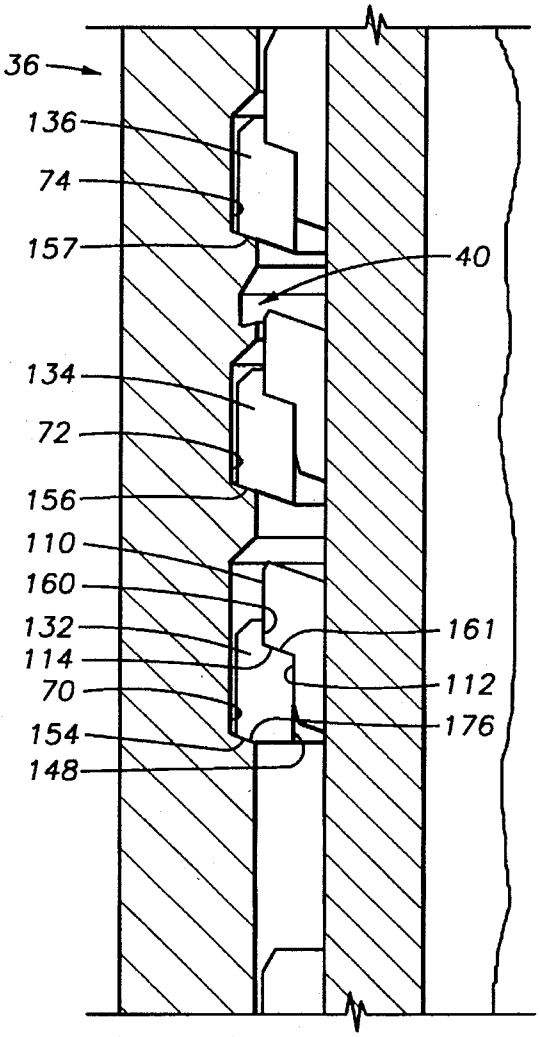
FIG. 12B is a side elevation view in cross-section showing the cage and inner casing hanger body in the suspending position.
Figure 11B:
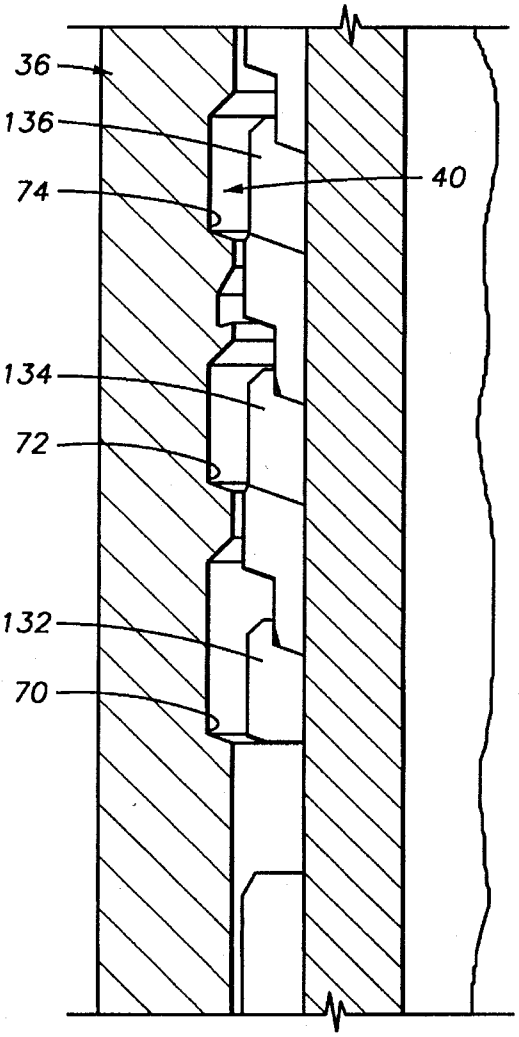
FIG. 11B is a side elevation view in cross-section showing the cage and inner casing hanger body in the expanded and triggering position.
Figure 10B:
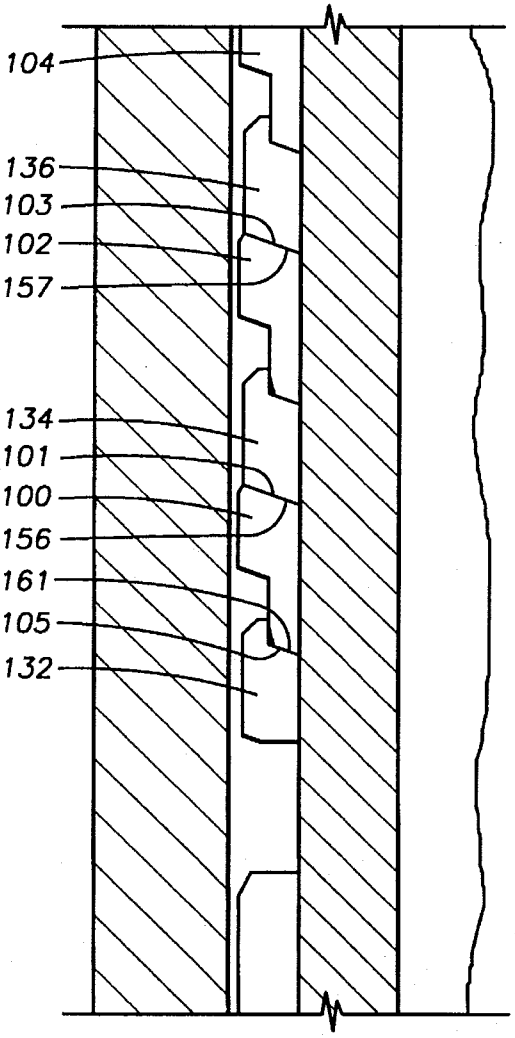
FIG. 10B is a side elevation view in cross-section showing the cage and inner casing hanger body in the running position.
Figure 12C:
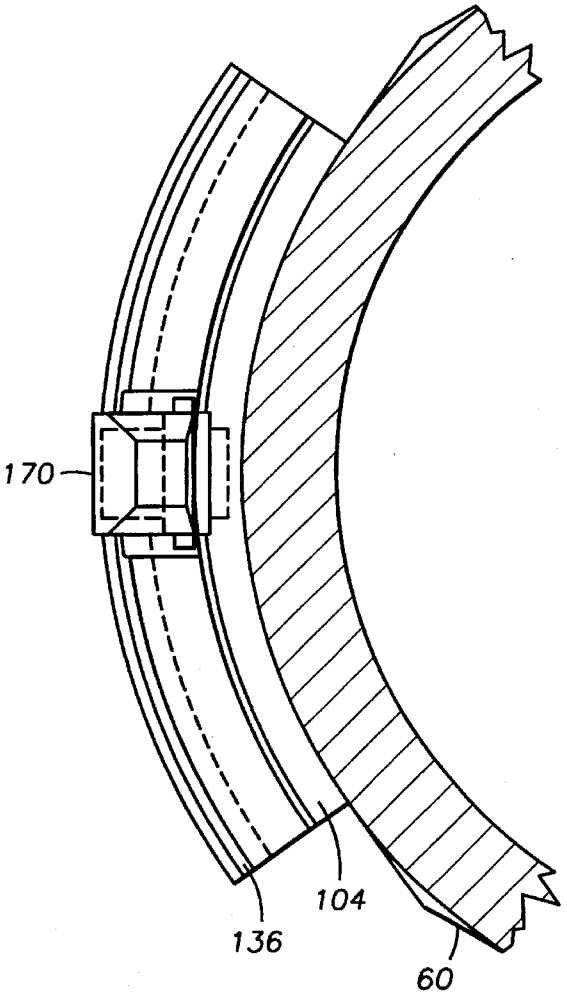
FIG. 12C is a top view, partly in cross-section, of the trigger and cage shown with the trigger and cage in the suspending position.
Figure 11C:
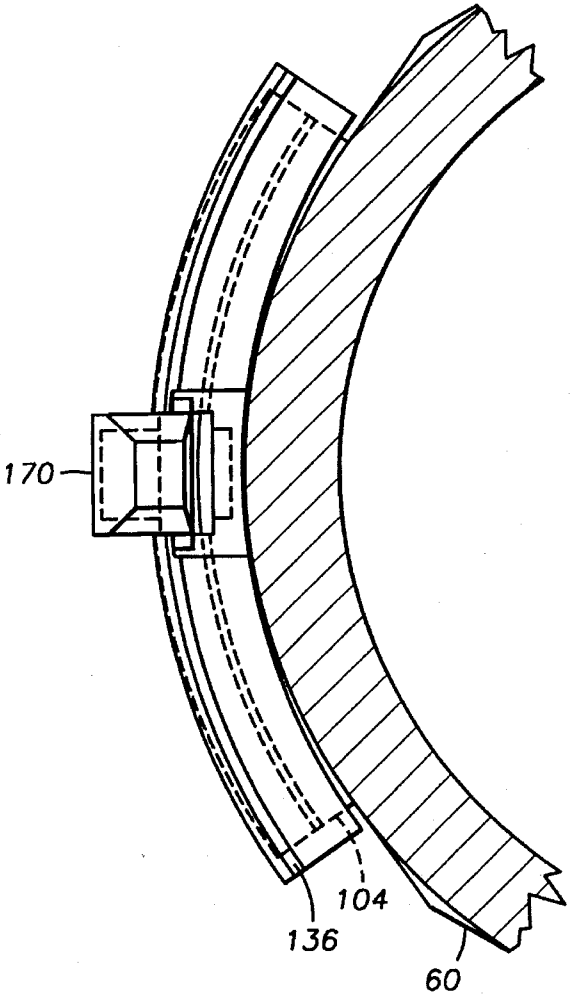
FIG. 11C is a top view, partly in cross-section, of the trigger and cage shown with the trigger in the expanded and triggering position.
Figure 10C:
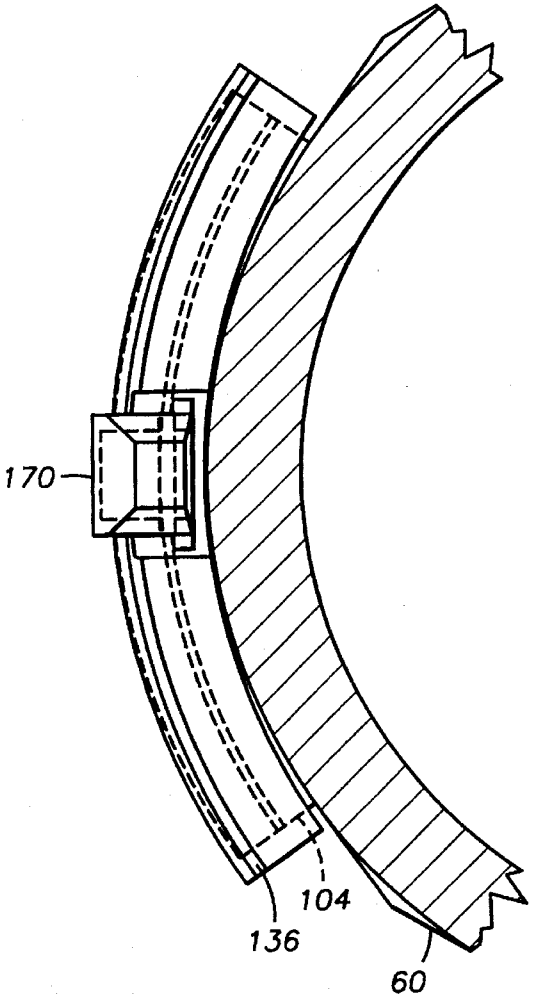
FIG. 10C is a top view, partly in cross-section, of the trigger and cage shown in the running position.
Figure 12D:
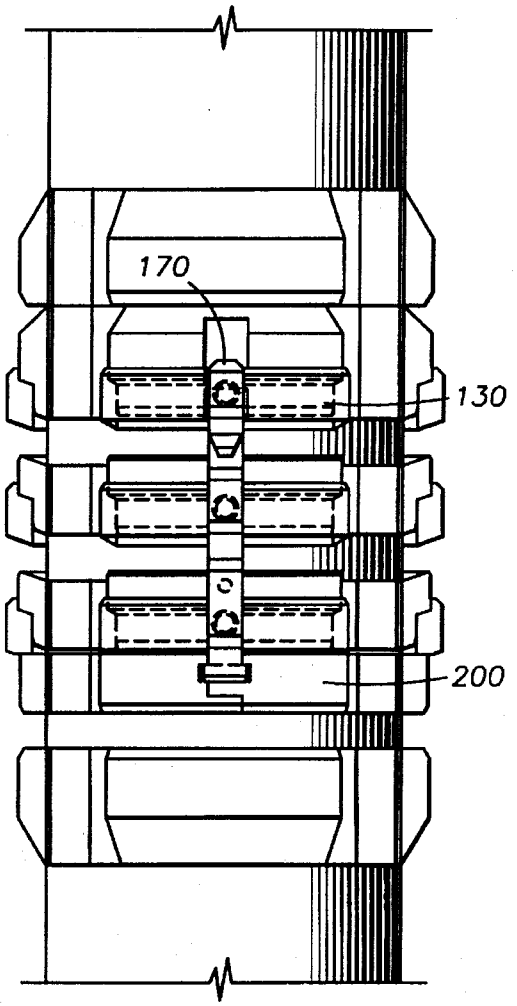
FIG. 12D is a side elevation view of the trigger and cage shown with the trigger and cage on the inner casing hanger body in the suspending position.
Figure 11D:
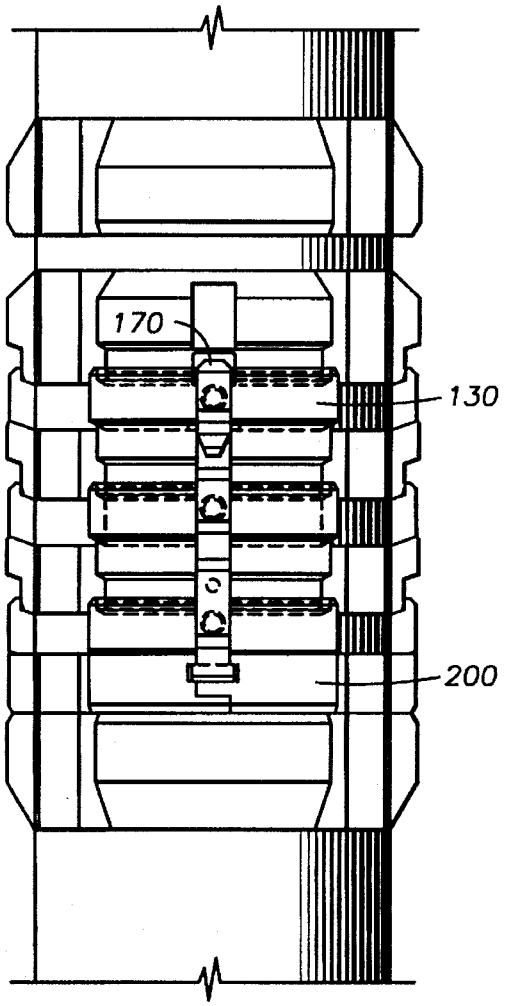
FIG. 11D is a side elevation view of the trigger and cage on the inner casing hanger body shown with the trigger in the expanded and triggering position.
Figure 10D:
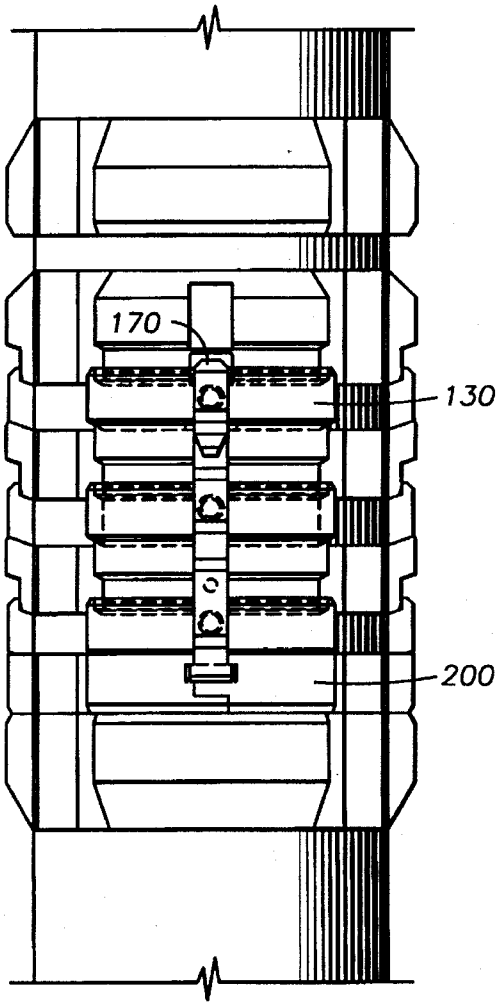
FIG. 10D is a side elevation view of the trigger and cage on the inner casing hanger body shown in the running position.

Referring now to FIGS. 10A, B, C and D in the running position, the production casing string 42 suspended in inner casing hanger 60 is lowered into the newly drilled borehole on production riser 44. The trigger 170 is biased outwardly by springs 150 against the walls of the various tubular members forming bore 66. The radial movement of the upper end 178 of trigger 170 is limited by the engagement of ears 182, 183 and flanges 159. The trigger 170 maintains the cage 130 in its radial inward and contracted position.

Figure 11A:
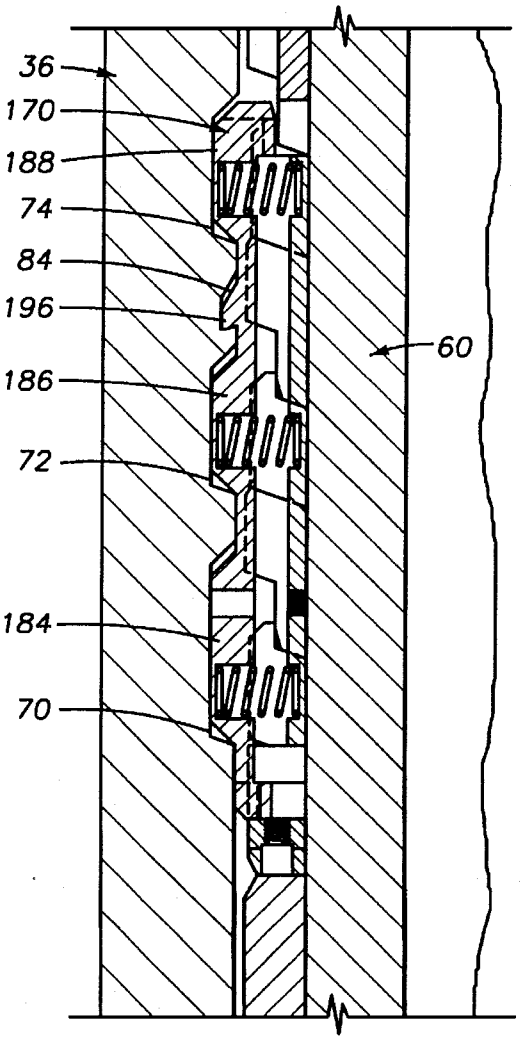
FIG. 11A is a side elevation view in cross-section of the trigger in the expanded and triggering position.

Referring now to FIGS. 11A, B, C and D in the triggering position, upon the projecting portions 184, 186, 188 of trigger 170 becoming aligned with grooves 70, 72, 74, respectively, as inner hanger 60 is lowered with the bore 66 of outer head 36, locator tang 196 engages locator surface 86 on profile 40 and is received within annular groove 84. Tang 196 is deformed if there is a misalignment. Trigger 170 then expands radially outward due to springs 150 and is received within profile 40 of outer intermediate casing head 36. As trigger 170 moves radially outward into profile 40, upper ears or wings 182, 183 and lower ears or wings 176, 177 move radially outward within notches 158 and T-slots 210. In this expanded radial position, the upper terminal end 178 of trigger 170 moves radially out of engagement with downwardly facing stop shoulder 123 on upper lug 104.

Figure 12A:
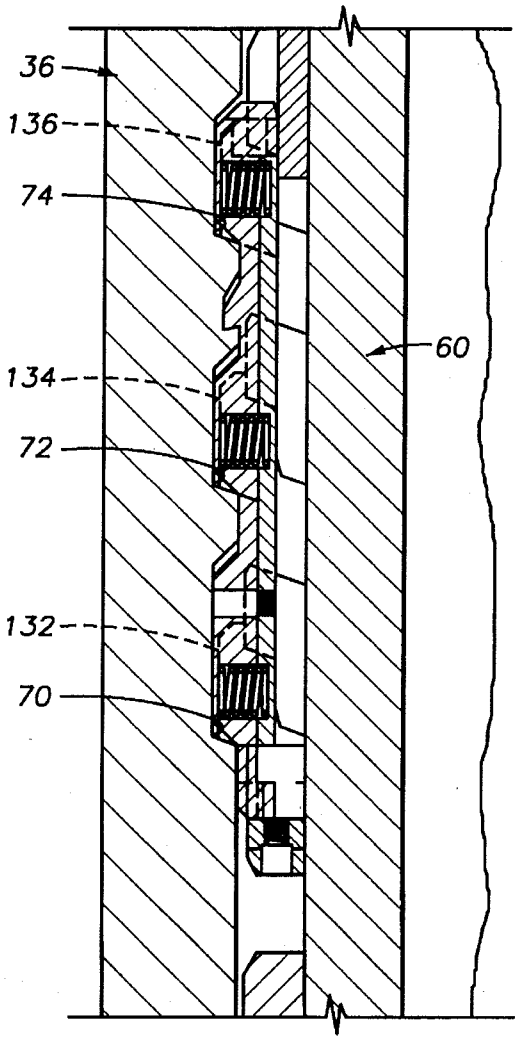
FIG. 12A is a side elevation view in cross-section of the trigger and cage in the suspending position.

Referring now to FIGS. 12A, B, C, and D in the suspending position, the reception of trigger 170 into profile 40, halts the downward travel of trigger 170 with respect to casing head 36. Upon the clearance of the triggers 170 with stop shoulders 123, the hanger body 90 of inner hanger 60 continues its downward longitudinal travel with respect to triggers 170. In particular, the upper terminal ends 178 of triggers 170 longitudinally slide onto flat 119 of upper lug 104. As casing hanger 60 continues to travel downwardly, ears 176, 177 on the terminal end 174 of trigger 170 and ears 182, 183 on the upper terminal end 178 of trigger 170 move out of T-slot 210 of trigger guard 200 and recess 158 at the upper end of cage 130 thereby allowing the further downward travel of inner hanger 60 and releasing cage 130 from its contracted position. The dogs 132, 134, 136 of cage 130 are then allowed to also be received within grooves 70, 72, 74 of profile 40 with bearing shoulders 154, 156, 157 engaging bearing surfaces 76 in recesses 70, 72, and 74, such that cages 130 halt further downward travel. As casing hanger 60 continues its downward travel, the inner bearing surfaces 112 of each of the segments 100, 102, 104 on hanger 60 move into bearing engagement with bearing surfaces 148. Likewise outer bearing surface 110 moves into notches 160. The further downward movement of hanger 60 allows inner bearing surfaces 112 of segments 100, 102, 104 to be cammed into engagement with the inner arcuate surface 148 of dogs 132, 134, 136 while simultaneously the outer bearing surfaces 110 of segments 100, 102, 104 are received within notches 160 of dogs 132, 134, 136. In its lowermost position, bearing shoulder 161 engages bearing member 114 and hanger 60 maintains each of the three sets of segments in the radially expanded and locked position for supporting the casing string 142 within outer casing string 34.

The present invention provides a hanger suspension system which increases the load carrying capacity of the inner hanger 60 by providing a plurality of load bearing shoulders between the load bearing members 100, 102, 104 of inner hanger 60 and dogs 132, 134, 136 of cage 130 and a plurality of load bearing shoulders between dogs 132, 134, 136 of cage 130 and load bearing surfaces 76 in recesses 70, 72 and 74 of profile 40 and outer head 36.

In a cementing operation, a borehole is drilled through the outer casing string 34, and hanger 60, supporting inner casing string 42, is lowered into the borehole. Upon the inner hanger 60 being received within the bore 66 of outer head 36, locator tang 196 engages locator shoulder 86 in profile 40 due to trigger member 176 being biased outwardly by springs 150. Upon the alignment of profile 40 with hanger assembly 125, triggers 170 expand radially outward into profile 40. Inner hanger 60 thereby releasing cages 130. Cages 130 are then cammed outwardly into circumferential grooves 70, 72, 74 with lugs 100, 102, 104 further traveling downward behind cages 130 to maintain cages 130 in load bearing relationship with inner hanger 60 and outer head 36.

Upon the suspension of inner casing string 42 within outer casing string 34, cement is pumped down the flow bore 92 of inner casing string 42. The cement flows around the lower terminal end of inner casing string 42 and first up the annulus formed between inner casing string 42 and the earth wall of the borehole and then up the annulus formed between inner and outer casing strings 42, 34, respectively. As the cement flows through the well, the inner hanger 60 and inner casing string 42 may be raised within outer casing head 36 and outer casing string 34. The camming shoulders of dogs 132, 134, 136 engage the camming surfaces of grooves 70, 72, 74, respectively, initially halting the upward movement of cage 130 with respect to hanger body 90. Upon bearing surfaces 110, 160 and 112, 148 disengaging, cages 130 contract radially inward allowing load bearing shoulders 154, 156, 157 to disengage load bearing surfaces 76 in grooves 70, 72, 74. After disengagement, the inner casing string may be raised and lowered above profile 40 to assist in the flow of the cement around the outside of inner casing string 42 to ensure that the cement fills all portions of the annulus around inner casing string 42. The drilling mud and cement returns are allowed to pass through linear flow passages 106, 107, and 108 until the cementing operation is completed.

Upon the completion of cementing operation, the inner casing string 42 and inner hanger 60 are again lowered within bore 66 to re, engage load bearing shoulders 154, 156, 157 with load bearing surfaces 76 of circumferential grooves 70, 72, 74. The cement is then allowed to set up to complete the cementing of the inner string 42 within the borehole.

While the present invention is described, for purposes of illustration only, as used in a mudline casing hanger system, the present suspension system may also be useful in other applications in suspending an inner tubular member from an outer tubular member in a well such as subsea wellheads, through bore surface wellheads, and downhole well tools such as liner hangers and well packers.

I claim:

1. A suspension system allowing reciprocation of an inner pipe string within an outer pipe string, comprising:

a hanger for suspending the inner pipe string;

a head on the outer string including a non-restrictive bore having tapering surfaces and load bearing surfaces in recessed circumferential grooves;

said hanger having outwardly extending load bearing members;

a hanger assembly mounted on said hanger, said hanger assembly including a plurality of expandable and contractible support members;

said support members having inner load bearing shoulders engaging said load bearing members and outer load bearing shoulders engaging said load bearing surfaces for suspending said hanger within said head in an expanded position, said support members having camming shoulders for engaging said tapering surfaces for releasing said hanger from said head in a contracted position;

whereby said hanger and inner pipe string may have reciprocable movement within said head and outer pipe in said contracted position.

2. An assembly for cementing an inner tubular string within an outer tubular string, the inner tubular string being supported by an inner hanger suspended on an outer head on the outer tubular string comprising:

said outer head having an inner diameter with a profile disposed within said inner diameter;

said inner hanger having an outer diameter with a plurality of radial outwardly projecting bearing members positioned on said outer diameter;

a plurality of movable support members mounted on said projecting bearing members and adapted for engagement with said profile;

a plurality of linear flow passages extending through said plurality of bearing members and support members, said linear flow passages having arcuate walls formed by said inner diameter and outer diameter; and said support members engaging said profile with said bearing members bearing against said support members upon said support members engaging said profile;

whereby the cement may flow through said linear flow passages and past the assembly.

3. A suspension system for suspending an inner and an outer tubular member to and from each other in a well by longitudinal movement of the inner member, comprising:

said inner tubular member having an outer circumferential surface with at least three sets of at least three longitudinally spaced radial outwardly extending load bearing members, said sets being azimuthally spaced about said outer circumferential surface and being separated by linear flow passages therebetween, a hanger assembly positioned on each said set and axially slidable on said outer circumferential surface and having inwardly extending load bearing shoulders mating with each of the corresponding load bearing members on said inner member;

said outer tubular member having a non-restrictive bore including load bearing surfaces in recessed circumferential grooves;

said hanger assembly further including outwardly extending load bearing shoulders for mating with each of the corresponding load bearing surfaces of said outer member upon alignment of said inner and outer members; and each said hanger assembly further including a trigger member for causing said outwardly extending load bearing shoulders to mate with said corresponding load bearing surfaces upon said alignment, portions of said trigger member being receivable within said outer tubular member.

4. The suspension system of claim 3 wherein each said hanger assembly further includes a plurality of longitudinally spaced arcuate members mounted on a transverse member, said arcuate members having said inwardly extending load bearing shoulders and said outwardly extending load bearing shoulders.

5. The suspension system of claim 4 wherein each of said arcuate members further includes outwardly extending camming shoulders adapted for engagement with camming surfaces in said recessed circumferential grooves.

6. The suspension system of claim 4 wherein each said arcuate members includes a longitudinal recess for receiving said trigger member.

7. The suspension system of claim 6 further including a biasing member disposed between said transverse member and trigger member for biasing said trigger member outwardly.

8. The suspension system of claim 4 wherein said radial outwardly extending load bearing members bear against said arcuate members upon said alignment to maintain said outwardly extending load bearing shoulders in engagement with said load bearing surfaces.

9. A method of suspending and cementing an inner casing string within an outer casing string of a well, comprising the steps of:

drilling a borehole thorough said outer casing string;

lowering the inner casing string into the outer casing string;

locating a hanger on the inner casing string within a head on the outer casing string;

expanding a plurality of outwardly extending load bearing shoulders axially slidably mounted on the hanger into corresponding recesses in the head;

engaging the outwardly extending load bearing shoulders with load bearing surfaces in the recesses;

engaging inwardly extending load bearing shoulders with load bearing members on the hanger;

pumping cement down the flow bore of the inner casing string and up the annulus between the inner and outer casing strings;

raising the hanger and inner casing string whereby the outwardly extending load bearing shoulders disengage the load bearing surfaces;

lowering and raising the inner casing string within the outer casing string to assist the flow of the cement around the inner casing string;

passing cement through a plurality of linear flow passages through the load bearing shoulders and members;

engaging the outwardly extending load bearing shoulders with the load bearing surfaces in the recesses; and allowing the cement to set.

10. A suspension system for suspending an inner and an outer tubular member to and from each other in a well by longitudinal movement of the inner member, comprising:

said inner tubular member having an outer circumferential surface with at least three sets of at least three longitudinally spaced radial outwardly extending load bearing members, said sets being azimuthally spaced about said outer circumferential surface and being separated by linear flow passages therebetween;

a hanger assembly positioned on each said set and axially slidable on said outer circumferential surface and having inwardly extending load bearing shoulders mating with each of the corresponding load bearing members on said inner member;

said outer tubular member having a non-restrictive bore including load bearing surfaces in recessed circumferential grooves;

said hanger assembly further including outwardly extending load bearing shoulders for mating with each of the corresponding load bearing surfaces of said outer member upon alignment of said inner and outer members; and each said hanger assembly further including a trigger member for causing said outwardly extending load bearing shoulders to mate with said corresponding load bearing surfaces upon said alignment, said trigger member including a deformable alignment member for being deformably received within a locator recess adjacent said recessed circumferential grooves.

* * * * *